United States Patent [19]

Rochette et al.

[11] Patent Number: 5,016,278

[45] Date of Patent: May 14, 1991

[54] METHOD AND DEVICE FOR CODING THE ENERGY OF A VOCAL SIGNAL IN VOCODERS WITH VERY LOW THROUGHPUT RATES

[75] Inventors: Denis Rochette, Paris; Pierre A. Laurent, Bessancourt, both of France

[73] Assignee: Thomson-CSF, Puteaux, France

[21] Appl. No.: 345,231

[22] Filed: May 1, 1989

[30] Foreign Application Priority Data

May 4, 1988 [FR] France ..... 88 06002

[51] Int. Cl.[5] ..... G10L 5/00

[52] U.S. Cl. ..... 381/36

[58] Field of Search ..... 381/36

[56] References Cited

FOREIGN PATENT DOCUMENTS 2608244 2/1976 Fed. Rep. of Germany .

OTHER PUBLICATIONS

Proceedings of the IEEE, vol. 73, No. 11, Nov. 1985, pp. 1551-1588, IEEE, New York, U.S., J. Makhoul et al.

*Primary Examiner*—Emanuel S. Kemeny

*Attorney, Agent, or Firm*—Oblon, Spivak, McClelland, Maier & Neustadt

[57] ABSTRACT

The method disclosed consists in analyzing the vocal signals in consecutive windows, in quantifying, on a determined number m of levels, the vocal signal in each of the windows and in measuring, in each of the windows, the vocal signal in each of the windows and in measuring, in each of the windows, the r-m-s value of the samples of the vocal signal. It consists constructing, in a vector space with n dimensions having, as its first base, the unit vectors ($E_0$ to $E_{n-1}$) of the energies measured on n consecutive windows, a resultant energy vector E corresponding to the sum of n energy vectors measured respectively in n windows of analysis of the vocal signal, then in achieving, in this space, a change of base having, as its first main axis, an oriented axis of unit vector having, as its components, the unit vectors of the first base, to project, in the new base obtained, the resultant energy vector. Codings on q bits such that $2^q=m$ of the component of the resultant vector projected on the main axis of the new base and on a reduced number of bits smaller than q, of the components of the energy vector projected on the n−1 other main axes of the vector space defined in the new base, are then made. An embodiment of a device corresponding to n=3 is described.

8 Claims, 4 Drawing Sheets

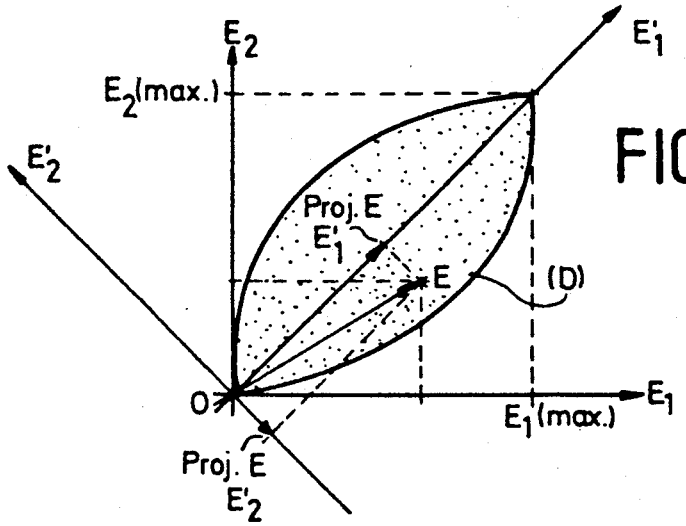
FIG.1
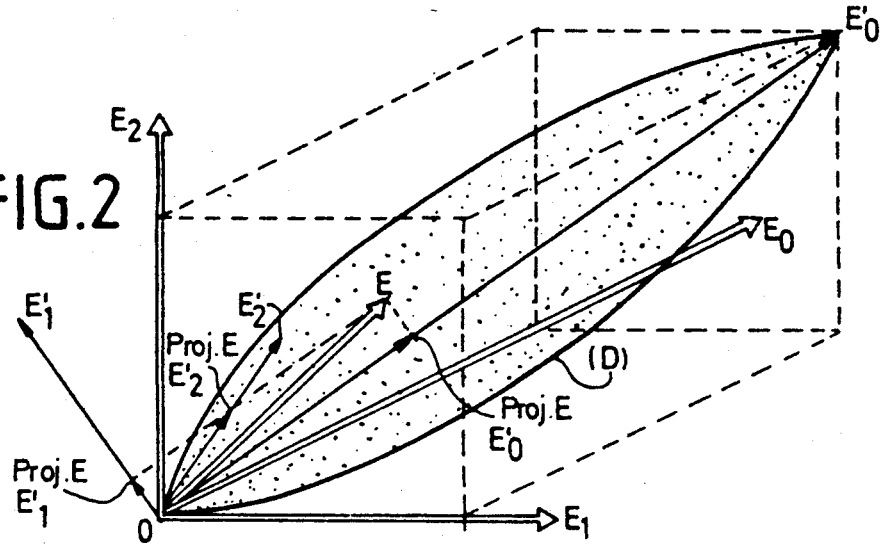
FIG.2
| | 1st main axis of inertia | 2nd main axis of inertia | 3rd main axis of inertia |
|---|---|---|---|
| Percentage of the total energy on the axis | 90 % | 8 % | 2 % |
| Unit vector 1st component | $3^{-\frac{1}{2}}$ | $-2^{-\frac{1}{2}}$ | $-6^{-\frac{1}{2}}$ |
| 2nd component | $3^{-\frac{1}{2}}$ | 0 | $2 \times 6^{-\frac{1}{2}}$ |
| 3rd component | $3^{-\frac{1}{2}}$ | $2^{-\frac{1}{2}}$ | $-6^{-\frac{1}{2}}$ |
FIG.3

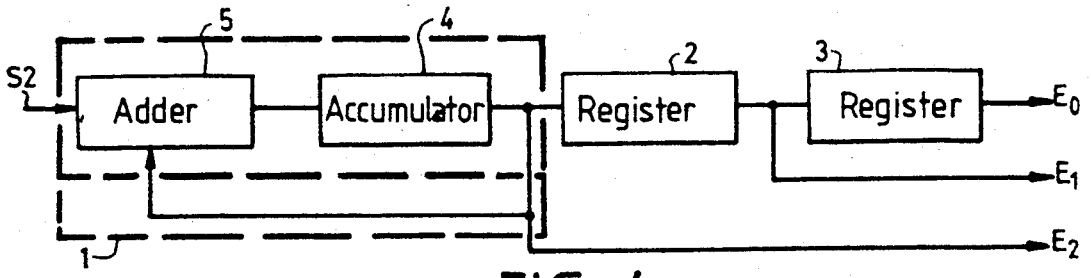
FIG. 4
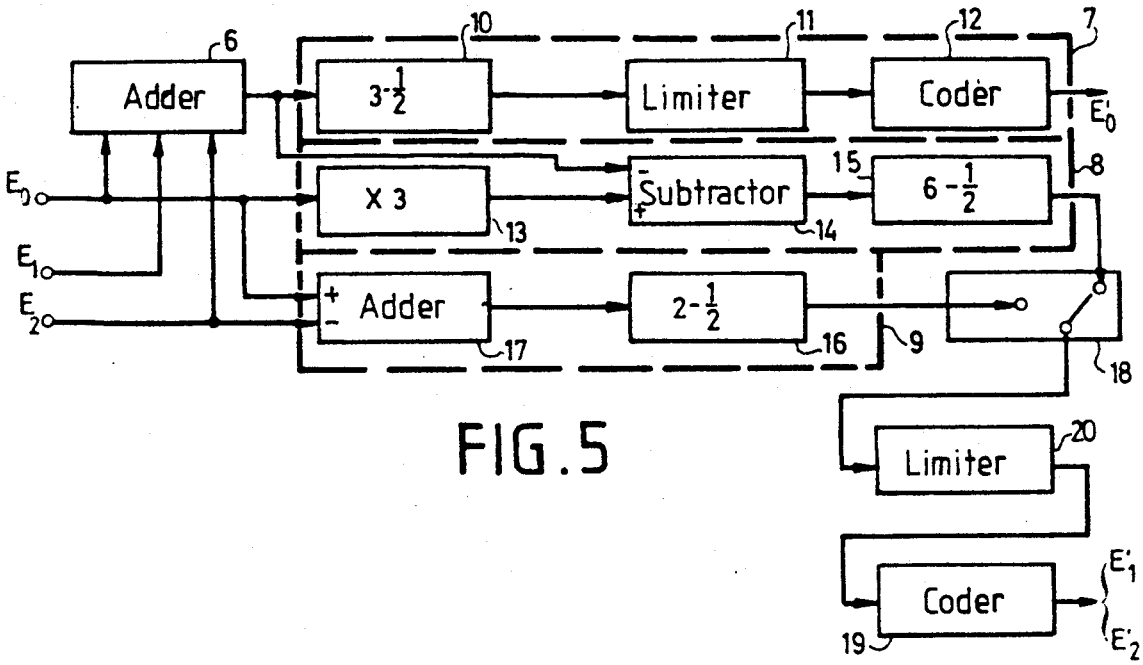
FIG. 5
FIG. 6
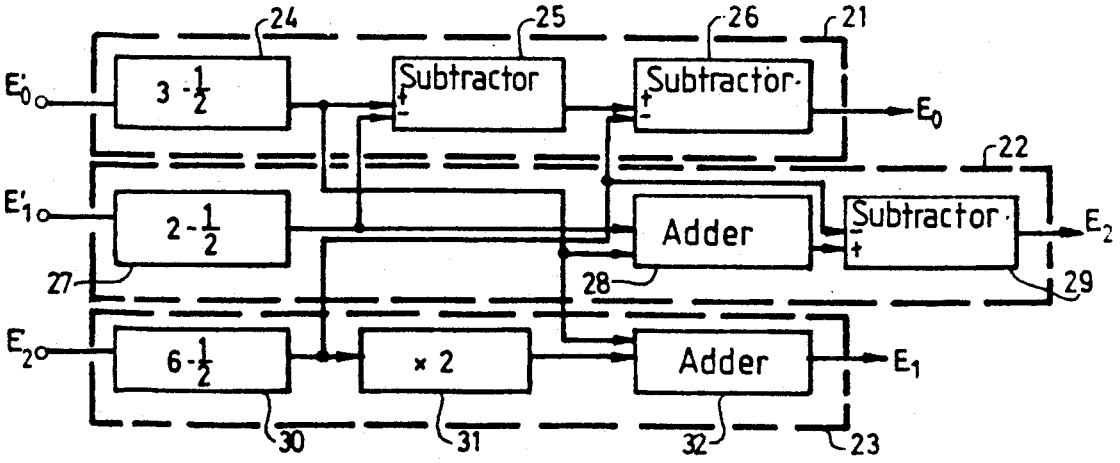

METHOD AND DEVICE FOR CODING THE ENERGY OF A VOCAL SIGNAL IN VOCODERS WITH VERY LOW THROUGHPUT RATES

BACKGROUND OF THE INVENTION

1. Field of the Invention

The present invention concerns a method and a device for coding the energy of the vocal signal in vocoders with very low throughputs.

It applies notably to the making of linear prediction vocoder devices of the type described in the "Revue Techniques Thomson-CSF" Vol. 14, No. 3, Sept. 1982, pages 715 to 731 and vol. 15, No. 2, pp. 495–516, published by MASSON, 120 Boulevard St. Germain, 75280 Paris.

2. Description of the Prior Art

In these devices, the vocal signal is cut up into time sections or windows with fixed lengths of about 20 milliseconds in the emission vocoders, and each signal window is analyzed to extract the parameters needed for the control of the digital filters of the reception vocoders. These parameters consist of the control coefficients of the reception filters, the r-m-s value of the vocal signal and an indication on whether on the nature of the vocal signal, whether it is voiced or not.

For the digital coding of the speech signal so as to ensure very low throughput links, typically of less than 1000 bits/s, the method for coding the r-m-s value parameter consists in quantifying this r-m-s value parameter on 32 values (0 to 31) according to a logarithmic scale standardized by the NATO standard "STANAG 4198", pertaining to order 10 linear predictive coding, a description of which is given in the article by M. TREMAIN, entitled "The Government Standard Linear Predictive Coding Algorithim-LPC10" published in the journal *Speech Technology*, April 1982, pages 40–49.

The r-m-s value signal quantified is then coded on 11 bits during three consecutive windows. The r-m-s value of the middle window is coded on five bits and that of each of the farthest windows is coded by a differential coding method on three bits with respect to the r-m-s value of the median window. A description of this coding method can be found in an article published by Wong D., Juang, B. H., Gray A. H., "An 800-bits/s Vector Quantization LPC Vocoder" in *IEEE Transactions on ASSP* Vol. 30, 1982, pp. 770 to 780.

However, the encoding on 11 bits of the r-m-s value parameter limits the possibilities of reducing the throughput rate of vocoders, notably to low throughput rates of less than 800 bits/second.

SUMMARY OF THE INVENTION

An aim of the invention is to overcome the above mentioned drawback.

To this effect, an object of the invention is a method for coding the energy of vocal signals in vocoders with very low throughput rates, of the type consisting in analyzing the vocal signals in consecutive windows, in quantifying, on a determined number m of levels, the vocal signal in each of the windows and in measuring, in each of the windows, the r-m-s value of the samples of the vocal signal, said method comprising the the step of constructing, in a vector space with n dimensions having, as its first base, the unit vectors ($e_l$ to $e_n$) of the energies measured on n consecutive windows, a resultant energy vector corresponding to the sum of n energy vectors measured respectively in n windows of analysis of the vocal signal, in achieving, in this space, a change of base having, as its first main axis, an oriented axis of unit vector having, as its components, the unit vectors of the first base, in projecting, in the new base obtained, the resultant energy vector and in coding, on q bits such that $2q=m$, the component of the resultant vector projected on the main axis of the new base, and in further coding, on a reduced number of bits smaller than q, the components of the energy vector projected on the $n-1$ other main axes of the vector space defined in the new base.

Another object of the invention is a device to implement the above mentioned method.

BRIEF DESCRIPTION OF THE DRAWINGS

Other characteristics and features of the invention will appear below from the following description, made with reference to the appended drawings, of which:

FIG. 1 shows the coding principle implemented by the invention in a two-dimensional space;

FIG. 2 shows the coding principle implemented by the invention in a three-dimensional space;

FIG. 3 is a summary table of the energies conveyed by the main axes of the three-dimensional space defined in the new base;

FIG. 4 shows a device implemented by the invention to measure the energy of the samples of the signal within each window of the signal;

FIG. 5 shows a device for the coding of the r-m-s value parameter according to the invention;

FIG. 6 shows a device for the decoding of the r-m-s value parameter according to the invention.

DETAILED DESCRIPTION OF THE INVENTION

Figure 7:
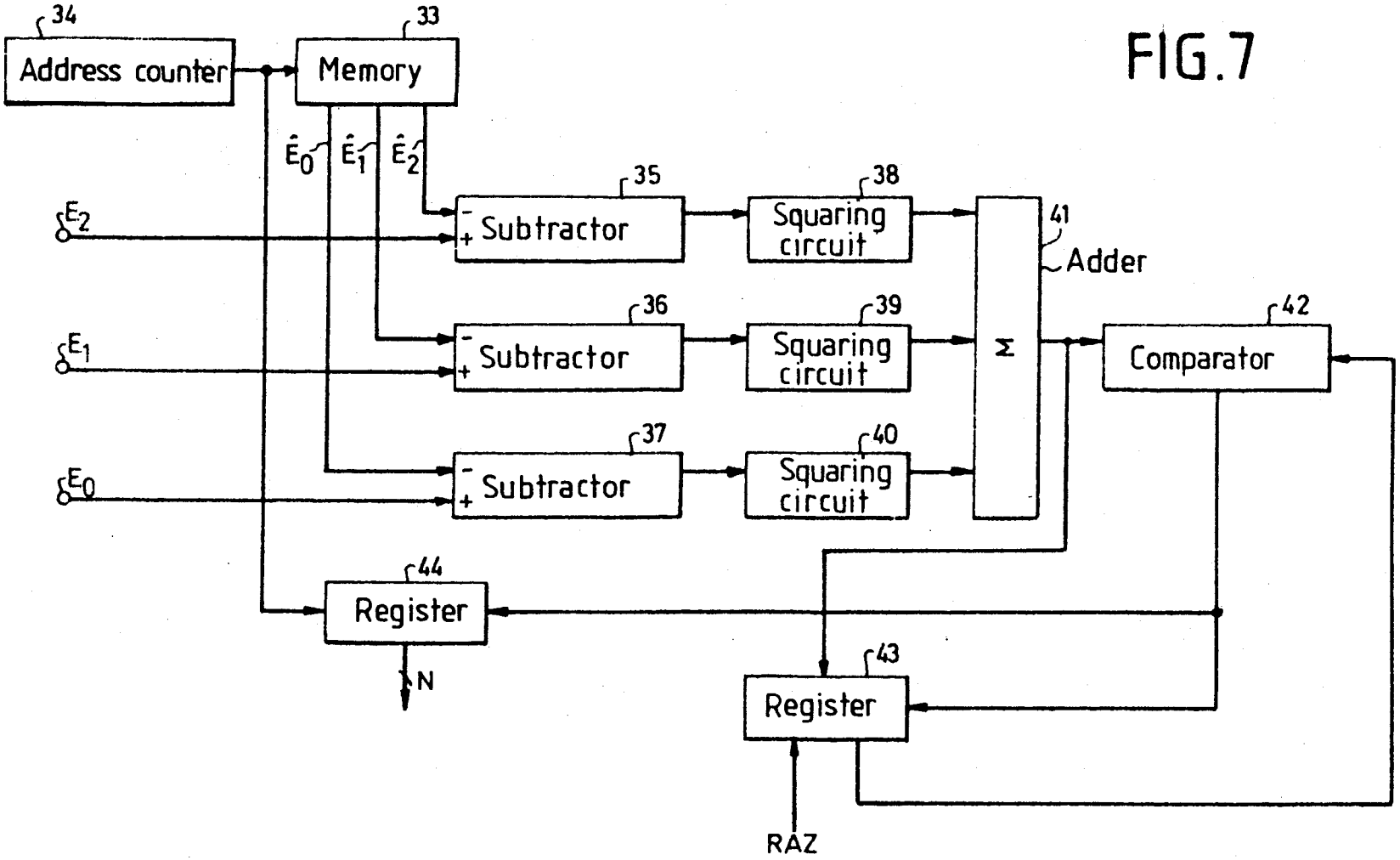
FIGS. 7 and 8 show second and third variants of devices for coding the r-m-s value parameter according to the invention.

The method according to the invention relies on the observation that the energy contained in the vocal signal varies very slowly in the course of time, so that the energies $E_0$, $E_1$ and $E_2$ of the samples quantified in each window of the signal may be considered to be highly correlated with one another. For, in considering solely a very large number of groups of two successive windows, and in referencing the corresponding energy vector of each group in a two-dimensional orthonormal vector space, where the energies $E_1$ and $E_2$ of each window represent the projections of the energy vector E of each group in the base representing this space, the origins of the energy vectors E of all the groups being identified with that of the two-dimensional vector space, it is possible to observe that the ends of the energy vectors E are distributed in the manner shown in FIG. 1 in a domain (D) of the plane formed by the two vectors $E_1$ and $E_2$, which are substantially symmetrical with respect to a bisector $E'_1$ of the angle ($E_1$, $E_2$) formed by the two vectors, in being greatly elongated in the direction of the bisector and, on the contrary, flattened in the direction perpendicular to it.

The same observation can be made by analyzing the energy of the speech signal by groups of n successive windows. For example, in a very great number of observations, it can be noted in representing, as in FIG. 2, the energies $E_0$, $E_1$ and $E_2$ in a three-dimensional space, that the ends of the vectors each resulting from the sum of three vectors $E_0$, $E_1$ and $E_2$ are all contained in a domain or "cloud" having three main axes of inertia.

On the axes $E_0$, $E_1$ and $E_2$ of the trihedron shown in FIG. 2, the unit vector of the first axis of inertia has, as its components $(3^{-\frac{1}{2}}, 3^{-\frac{1}{2}}, 3^{-\frac{1}{2}})$, the unit vector of the second axis of inertia has, as its components $(-2^{-\frac{1}{2}}, 0, 2^{-\frac{1}{2}})$ and the unit vector of the third axis of inertia, has as its components $(-6^{-\frac{1}{2}}, 2\times 6^{-\frac{1}{2}}, -6^{-\frac{1}{2}})$ As indicated in the table of FIG. 3, it appears that, in projecting the energy of each vector E with components $E_0$, $E_1$, $E_2$ on each axis of inertia, the percentages of the energies of the vectors projected are 90% for the first axis, 8% for the second axis and only 2% for the third axis. It appears that a saving in coding bits can be achieved by not coding the components $E_0$, $E_1$ and $E_2$ throughout the space of maximum coding formed by the cube, for which the lengths of the sides represent the maximum energy values $E_{0max}$, $E_{1max}$ and $E_{2max}$ which may be assumed by the speech signal along three consecutive windows but by encoding, on the contrary, their resultant E in the new orthonormal base formed by the three unit vectors forming the main axes of inertia, which occupies only a low volume of the above-defined cube.

Letting P designate the matrix of components of the three unit vectors, such that:

$$P = \begin{matrix} a & b & c \\ a & o & 2\times c \\ a & -b & c \end{matrix} \text{ with } a = 3^{-\frac{1}{2}},\ b = -2^{-\frac{1}{2}} \text{ and } c = -6^{-\frac{1}{2}}$$

and letting ($E'_0$, $E'_1$ and $E'_2$) designate the components in the new base of the vector resulting from the addition of the three vectors $E_0$, $E_1$ and $E_2$, the vector with components ($E'_0$, $E'_1$ and $E'_2$) verifies the following matrix relationship:

$$[E'] = P^{-1} x\ [E] = {}^tP\ x\ [E]$$

In this relationship, the matrix [E'] has, as its column vectors, the components $E'_0$, $E'_1$ and $E'_2$, the matrix [E] has, as its column vectors, the components $E_0$, $E_1$ and $E_2$, and ${}^tP$ designates the transposed matrix of P. By way of example, the preceding conversions make it possible, in limiting the values of $E'_0$ between 0 and 54, to encode it on only four bits according to a linear scale ranging between these two values, and in truncating the values $E'_1$ and $E'_2$ between the values $-16$ and $+16$. These may be coded respectively on three bits and two bits, also according to a linear scale also ranging between these two values. The result is then the obtaining of three coded values ($E'_0$, $E'_1$ and $E'_2$) on a total of only nine bits instead of eleven in the prior art, and this is enough to ensure high quality transmissions at 800 bits/s.

In reception, the operations performed are the reverse of the coding operations. Using the coded values $E''_0$, $E''_1$ and $E''_2$, the procedure determines, in a first step, the vector with components $E'_0$, $E'_1$ and $E'_2$ expressed in the base of unit vectors of the main axes of inertia, Then, in a second step, it multiplies the matrix P by the vector with components $E'_0$, $E'_1$ and $E'_2$ to obtain a vector with components $E_0$, $E_1$ and $E_2$. Finally, in a third step, it applies, to the components $E_0$, $E_1$ and $E_2$, the law for the decoding of the order 10 linear predictive coding standard to obtain the three r-m-s values $RMS_0$, $RMS_1$ and $RMS_2$ of the three consecutive signal windows processed.

A corresponding coding device is shown in FIGS. 4 and 5. In FIG. 4, the device for measuring the energy of samples of the vocal signal includes an accumulator circuit 1, shown inside a closed line of dashes, said circuit being coupled to two series-connected registers 2 and 3. The accumulator circuit 1 consists, in a known way, of an accumulating register 4 and an adder circuit 5. Each sample $S_i$ of the vocal signal is applied to a first operand input of the adder circuit 5 and is added to the content of the accumulating register 4 which is applied to the second operand input of the adder circuit 5. The samples $S_i$ of one window thus get accumulated in the accumulating register 4 throughout the duration of the window. At the end of each window, the content of the accumulator 4 is transferred into the register 2, where it is then loaded, at the following window, in the register 3. In established mode, the contents of the registers 3, 2 and 4 give a permanent indication, at the end of a window, of the respective energies $E_0$, $E_1$ and $E_2$ contained in three consecutive windows for the exploration of the vocal signal. These energy values $E_0$, $E_1$ and $E_2$ are applied to the coding device of FIG. 5, at the corresponding inputs of an adder circuit 6. The coding device also includes three processing channels 7, 8 and 9, shown within closed lines of dashes. The channel 7 comprises an attenuator circuit 10 with an attenuation ratio $3^{-\frac{1}{2}}$, a limiter stage 11 and a coder 12. All the elements 10, 11, 12, are coupled to one another, in this order, and in series to the output of the adder circuit 6. The channel 8 has an amplifier circuit 13 with a gain 3, coupled to an attenuator circuit 15, with an attenation ratio $6^{-\frac{1}{2}}$through a subtractor circuit 14. The subtractor circuit 14 has a first operand input marked "+", which is connected to the output of the amplifier circuit 13 and a second operand input marked "−" connected to the output of the adder circuit 6.

The channel 9 has an attenuator circuit 16 with an attenuation ratio $2^{-\frac{1}{2}}$coupled to the output of an adder circuit 17. A shunting circuit 18 applies either of the signals, obtained at the output of the channels 8 and 9 to the input of a coder 19 through a limiter stage 20.

The reception decoder is shown in FIG. 6. It has a set of three reception channels 21, 22 and 23, shown within closed lines of dashes.

The first channel 21 has the following series-connected elements: an attenuation circuit 24 with an attenuation ratio $3^{-\frac{1}{2}}$and two subtractor circuits 25 and 26.

The second channel 22 has the following series-connected elements: an attenuation circuit 27 with an attenuation ratio $2^{-\frac{1}{2}}$, an adder circuit 28 and a subtractor 29.

The third channel 23 has the following series-connected elements: an attenuation circuit 30 with an attenuation ratio $6^{-\frac{1}{2}}$, an amplifier 31 with a gain 2 and an adder circuit 32.

The subtractor circuit 25 is connected by a first operand input, marked "+", to the output of the attenuator circuit 24, and by a second operand input, marked "−", to the output of the attenuator circuit 27. The result of the subtraction performed by the subtractor circuit 25 is applied to a first operand input, marked "+", of the subtractor circuit 26. The second operand input, marked "−", of the subtractor circuit 26 is connected to the output of the attenuator circuit 30. The output of the subtractor circuit 26 supplies the energy $E_0$of the first window of the vocal signal. The adder circuit 28 has a first operand input, connected to the output of the attenuator circuit 27, and a second operand input, connected to the output of the attenuator circuit 24. The result obtained at the output of the adder circuit 28 is applied to a first operand input, marked "+", of the subtractor circuit 29. The second operand input, marked "−", of the subtractor circuit 29 is connected to the output of the attenuator circuit 30. The energy $E_2$ of the signal is obtained at the output of the subtractor circuit 29. Finally, the adder circuit 32 is connected, by a first operand input, to the output of the amplifier 31 and, by a second operand input, to the output of the attenuator circuit 24. The energy $E_1$ of the signal is obtained at the output of the adder circuit 23.

Rather than doing a scaler coding of the vector $E'_0$, $E'_1$, $E'_2$ in the base of the three unit vectors of the main axes of inertia, a second variant of a method of implementing the method according to the invention may consist in performing, as shown in FIG. 7, a vector coding of the vector ($E'_0$, $E'_1$, $E'_2$), in seeking the vector closest to the vector ($E'_0$, $E'_1$, $E'_2$) among $2^N$ vectors, the ends of which would coincide with the nodes of a subset terminated by a face-centered cube lattice so as to obtain a coding on N bits. This mode of coding is achieved by the circuits of FIG. 7 which include a programmable read-only memory 33, addressed by an address counter 34, three subtractor circuits 35 to 37, three squaring circuits 38 to 40, a summator circuit 41, a comparator circuit 42 and two registers 43 and 44. The read-only memory 33 contains all three components of the $2^M$ estimated vectors ($E_0$, $E_1$ and $E_2$), and these are addressed by the address counter with N bits 24. Each of the components read in the memory 33 is respectively applied to a first operand input of the subtractor circuits 35 to 37. The components $E_0$, $E_1$ and $E_2$ of the energy of the vocal signal of each of the three windows are applied respectively to the second operand inputs of the subtractor circuits 35 to 37. The results of the subtractions performed by the subtractor circuits 35 to 37 are respectvely applied to the input of the squaring circuits 38 to 40, and the results of the squaring operations are applied to the inputs of the summator circuit 41. The sums of the squares of the differences between each component ($E_0$, $E_1$ and $E_2$) of a vector representing the energies of the vocal signal in three consecutive windows, and the components ($E_0$, $E_1$ and $E_2$) of an estimated vector addressed by the address counter 34 are successivly applied by the output of the summator circut 41 to a first comparison input of a comparator circuit 42 to be compared with the content of the register 43 which is applied to the second comparison input of the comparator 42. At each comparison, the content of the register 43 is updated by the result of the summation obtained at the output of the summator circuit 41, if this result is smaller than the content existing in the register 43. As a result, after each progression of the address counter 34, the register 43 retains, in memory, that sum of the squares obtained from the summator circuit 41 which is the smallest of all the sums already made from the start of the addressing of the estimated vectors in the memory 33. At the same time as each updating of the content of the register 43, the content of the register 44 is replaced by the address of the corresponding vector, which was read in the memory 33. We thus obtain, directly in the register 44, the number of the r-m-s value vector coded on N bits.

Figure 8:
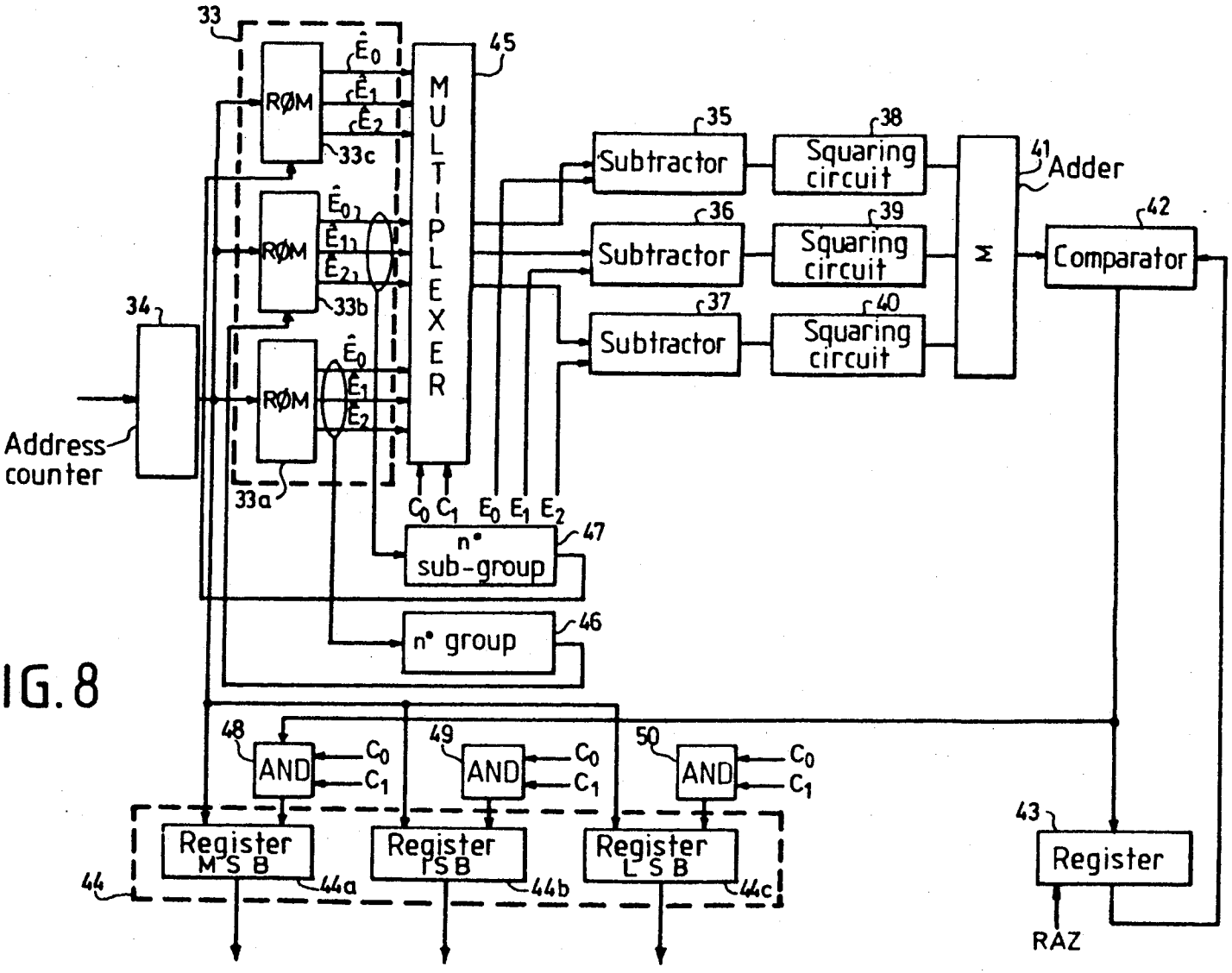

A third variant of a method for implementing the method of the invention is shown in FIG. 8. As this third variant flows from the embodiment of the second variant described above, the homologous elements of FIG. 7 are shown in FIG. 8 with the same references. This third variant differs from the preceding one by the fact that the space of the memory 33 is divided into three memory subspaces $33_a$, $33_b$ and $33_c$. In this case, the n/3 first bits of the address counter 34 address the subspaces $33_a$, the following n/3 bits address the second subspace and the remaining n/3 bits address the subspace $33_c$. This enables a vector representation of the vectors in a three-dimensiional space having the shape of a face-centered cube lattice in assigning, to each vector, a group and a subgroup of this space. In assigning the groups of the cube lattice to the memory space $33_a$, the subgroups to the memory space $33_b$, $2^{n/3}$ estimated energy vectors can be coded in the memory space $33_a$ and $2^{n/3}$ estimated energy vectors can be coded in the memory space $33_b$. The remaining $2^{N/3}$ vectors are encoded in the memory space $33_c$. For N=9, we thus obtain eight groups each comprising eight subgroups of eight vectors.

In a manner similar to that of the device shown in FIG. 7, the energy of the vocal signal having components $E_0$, $E_1$ and $E_2$, is measured by the circuits 35 to 43 in relation to the energy of the corresponding estimated vectors, successively formed through a multiplexer 45 by the memories $33_a$, $33_b$ and $33_c$.

We thus successively define the group, the subgroup and then the vector of the subgroup having the energy closest to the vector with components $E_0$, $E_1$ and $E_2$. The group, subgroup and vector Nos. within a subgroup are respectively recorded in the register 44 which has, in FIG. 8, the form of a bank of registers consisting of registers $44_a$, $44_b$ and $44_c$. AND gates 48, 49 and 50 enable the transfer of addresses of groups, subgroups vectors within a group, whenever the result of the comparison, made by the comparator 42, indicates that the sum formed by the summator 41 is smaller than the content of the register 43.

What is claimed is:

1. A method for coding energy of vocal signals in linear prediction vocoders with very low throughput rates, including analyzing the vocal signals in consecutive windows, quantifying, on a determined number m of levels, the vocal signal in each of the windows and measuring, in each of the windows, a r-m-s value of the quantified levels of the vocal signal, comprising the steps of:

constructing, in a vector space in n dimensions, said vector space having a first base comprised of unit vectors ($e_1$ to $e_n$) of energies measured on n consecutive windows, a resultant energy vector corresponding to a sum of n energy vectors measured respectively in said n windows of analysis of the vocal signal;

achieving, in said vector space, a change of base, said changed base having, as a first main axis, an oriented axis having, as components, the unit vectors of the first base;

projecting, in the changed base, the resultant energy vector;

coding, on q bits such that 2q=m, a component of the resultant vector projected on the first main axis of the changed base; and coding, on a reduced number of bits smaller than q, components of the resultant vector projected on n-1 other main axes of the vector space defined in the changed base.

2. A method according to claim 1, wherein the vector space comprises a three-dimensional space wherein, the unit vectors borne by the main axes of the new base have, as their component in the base defined by the vecotrs of the three-dimensional space representing the energies measured on three consecutive windows, respectively ($3^{\frac{1}{2}}$, $3^{\frac{1}{2}}$, $3^{\frac{1}{2}}$), for the first main axis, ($-2^{\frac{1}{2}}$, $2\times 6^{\frac{1}{2}}6^{\frac{1}{2}}$) for the third main axis.

3. A method according to claim 2, comprising the codings of the resultant energy vector, projected on the first, second and third main axes, having respective lengths of four, three and two bits.

4. A device for coding the energy of a vocal signal by a linear prediction vocoder with very low throughput rate, comprising:

means for quantifying, on a determined number m of levels, the vocal signal in each of a determined number of consecutive windows of the vocal signal;

means for measuring, in each window, a r-m-s value of the quantified levels of the vocal signal;

matrix computation means for projecting, in a vector base having, as a first main axis, an oriented axis, having as components, unit vectors of a first base, said unit vectors respectively representing energies measured within said windows, a resultant vector resulting from summing the energy vectors measured in each window of the vocal signal; and means for coding each component of the resultant vector, projected in the vector base.

5. A device according to claim 4 comprising, for n=3, the matrix computation means achieving the matrix product:

$$[E']=P^{-1}[E]$$

wherein [E] is a column vector formed by components $E_0$, $E_1$, $E_2$ energies measured on three successive windows and, $$P^{-1} = \begin{matrix} a & a & a \\ b & o & b \\ c & 2\times c & c \end{matrix} \text{ with } a = 3^{-\frac{1}{2}},\ b = -2^{-\frac{1}{2}} \text{ and } c = 6^{-\frac{1}{2}}$$

6. A device according to claim 4, further comprising means for seeking, in a set of $2^N$ vectors, prerecorded in a memory, the ends of said set of $2^N$ vectors coinciding with the nodes of a subset terminated by a face-centered cube lattice, a vector which has components in the vector base that are closest to components $E_0$, $E_1$, $E_2$ of energies measured on three successive windows of the vocal signal, so as to represent the code of the resultant vector on N bits.

7. A device according to claim 6, comprising a memory organized in N/3 groups, N/3 subgroups of N/3 vectors each.

8. A device according to claim 7, further comprising:

an address counter to address the vectors prerecorded in the memory;

subtractor circuits to compare N r-m-s values of the vocal signals given by N windows with the N respective components of values read in the memory; and a decision circuit to identify a vector read in the memory which has components closest to the N measured r-m-s values of the vocal signal.

* * * * *